US008639164B2

(12) United States Patent
Kuge et al.

(10) Patent No.: US 8,639,164 B2
(45) Date of Patent: Jan. 28, 2014

(54) TONER CARTRIDGE AND IMAGE FORMING APPARATUS

(75) Inventors: Hideki Kuge, Ebina (JP); Yoshiyuki Takashima, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 523 days.

(21) Appl. No.: 12/777,647

(22) Filed: May 11, 2010

(65) Prior Publication Data

US 2011/0142499 A1 Jun. 16, 2011

(30) Foreign Application Priority Data

Dec. 15, 2009 (JP) ..... 2009-284556

(51) Int. Cl.
*G03G 15/08* (2006.01)

(52) U.S. Cl.
USPC ..... 399/262; 399/120; 399/258

(58) Field of Classification Search
USPC ..... 399/262
See application file for complete search history.

(56) References Cited

U.S. PATENT DOCUMENTS

| | | | | |
|---|---|---|---|---|
| 2006/0285885 | A1* | 12/2006 | Lee | 399/262 |
| 2009/0129827 | A1 | 5/2009 | Ichikawa et al. | |
| 2010/0008698 | A1 | 1/2010 | Ichikawa et al. | |

FOREIGN PATENT DOCUMENTS

| | | | |
|---|---|---|---|
| CN | 101436020 | A | 5/2009 |
| JP | 2009-122559 | A | 6/2009 |
| TW | 127357 | B | 12/1990 |
| TW | I269946 | B | 1/2007 |
| TW | 200720865 | A | 6/2007 |

OTHER PUBLICATIONS

Office Action dated May 14, 2013 issued by the State Intellectual Property Office of PR China, in correspondence to Application No. 201010211753.9.

Office Action, dated Jun. 27, 2013, issued by the Taiwanese Patent Office, in counterpart application No. 099118526.

* cited by examiner

*Primary Examiner* — David Gray
*Assistant Examiner* — Andrew Do
(74) *Attorney, Agent, or Firm* — Sughrue Mion, PLLC

(57) ABSTRACT

According to an aspect of the invention, a toner cartridge includes a container body, a first cover, and a second cover. The container body contains toner and that has an opening portion provided on an outer face of the container body and a guide piece provided on the outer face. The first cover opens and closes the opening portion. The second cover is supported by the guide piece and that is movable in an noncontact state with a bottom portion of the first cover to cover the first cover when the container body is pulled out from an image forming apparatus.

18 Claims, 15 Drawing Sheets

TONER CARTRIDGE AND IMAGE FORMING APPARATUS

CROSS-REFERENCE TO RELATED APPLICATIONS

This application is based upon and claims priority under 35 USC 119 from Japanese Patent Application No. 2009-284556, filed Dec. 15, 2009.

BACKGROUND

1. Technical Field

The present invention relates to a toner cartridge and an image forming apparatus using the toner cartridge.

2. Related Art

There is known a toner cartridge for supplying toner to an image forming apparatus. The toner cartridge is attached to and is detached from the image forming apparatus. When toner in the image forming apparatus is insufficient, the toner cartridge is replaced.

SUMMARY OF THE INVENTION

According to an aspect of the invention, a toner cartridge includes a container body, a first cover, and a second cover. The container body contains toner and that has an opening portion provided on an outer face of the container body and a guide piece provided on the outer face. The first cover opens and closes the opening portion. The second cover is supported by the guide piece and that is movable in an noncontact state with a bottom portion of the first cover to cover the first cover when the container body is pulled out from an image forming apparatus.

BRIEF DESCRIPTION OF THE DRAWINGS

Exemplary embodiments of the invention will be described in detail based on the following figures, wherein.

DETAILED DESCRIPTION

Hereinafter, exemplary embodiments of the invention will be described with reference to the accompanying drawings.

Figure 1:
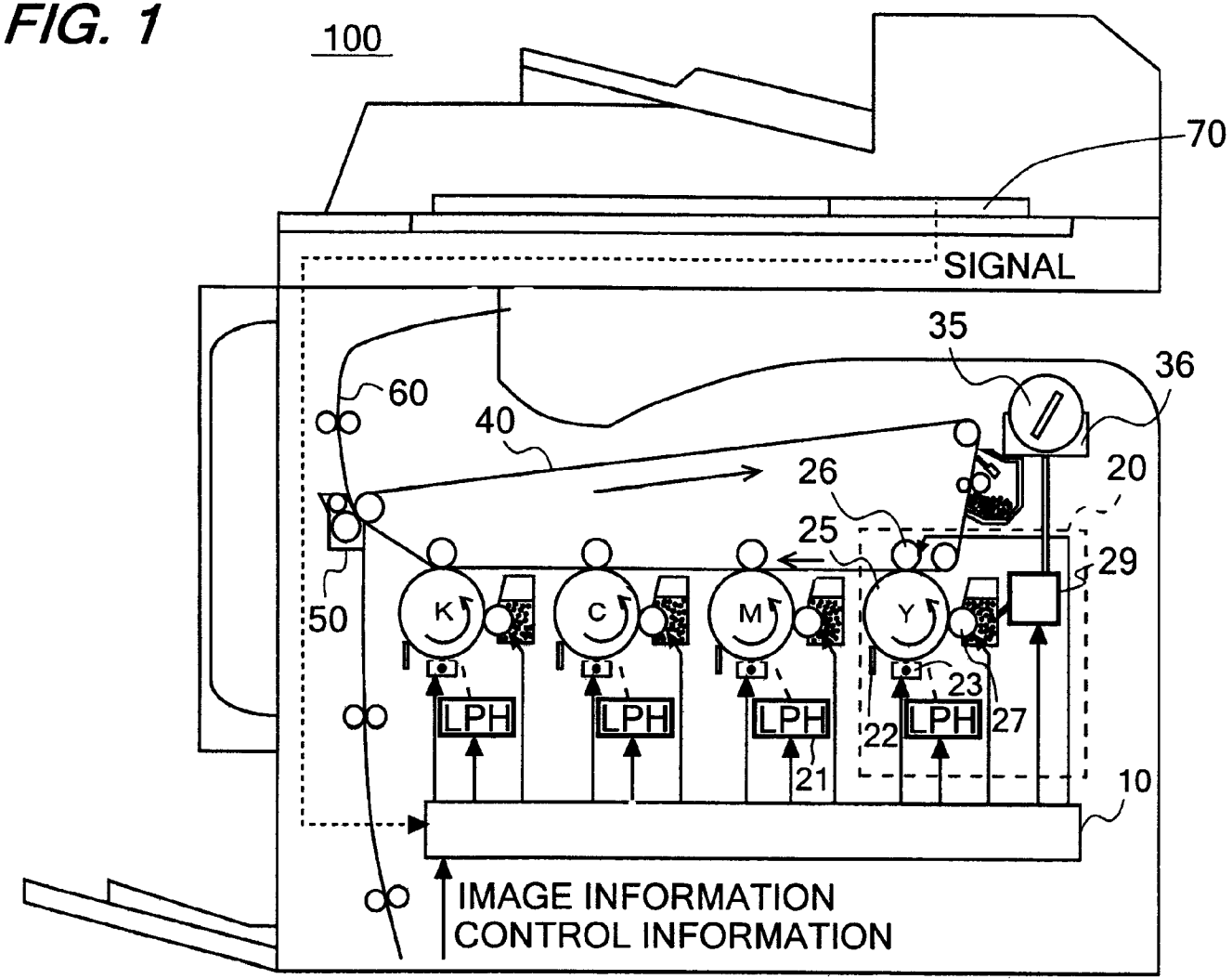
FIG. 1 is a diagram illustrating an example of a configuration of an image forming apparatus.

FIG. 1 is a diagram illustrating an example of a configuration of an image forming apparatus 100. The image forming apparatus 100 includes at least a controller 10, an image forming unit 20, a toner cartridge 35, a toner cartridge receiving unit 36, an intermediate transferring member 40, a secondary transferring device 50, and an input unit 70. In FIG. 1, the tandem type image forming apparatus 100 is illustrated. However, a rotary type image forming apparatus 100 may also be employed.

The controller 10 has a hardware configuration in which, for example, a CPU, a RAM such as an SRAM (Static Random Access Memory), a DRAM (Dynamic RAM), an SDRAM (Synchronous DRAM), or an NVRAM (Non Volatile RAM), a ROM (Read Only Memory) such as a flash memory, and an input/output I/F (interface) are connected via buses. The control unit 10 controls operations of each component of the image forming unit 20, the intermediate transferring member (for example, a transfer belt having a belt shape) 40, and the secondary transferring device 50 on the basis of signals input through the input unit 70. The control operation is implemented by the CPU reading programs stored in a storage device such as the ROM and performing operations according to the corresponding programs.

The image forming unit 20 includes an LPH (LED Printing Head) 21 in which LEDs are arrayed as an example of an exposure unit, a cleaning blade 22 as an example of a cleaning unit, a charging device 23 as an example of a charging unit, a photosensitive drum 25 as an example of an image carrying member, a transferring roller 26 as an example of a primary transferring unit, a developing device 27 as an example of a developing unit, and a dispenser 29 having a unit for carrying toner (not shown) therein as an example of a unit for supplying toner to the developing device 27.

In FIG. 1, yellow (Y), magenta (M), cyan (C), and black (K) image forming units 20 have the same configuration. Therefore, although the dispenser 29 is allocated to each of the magenta, cyan, and black image forming units, the dispensers 29 of the image forming units excluding the yellow image forming unit are not illustrated. In addition, the toner cartridge receiving portion 36 and the toner cartridge 35 connected to the dispenser 29 of the image forming units excluding the yellow image forming unit are not illustrated. In the following description, as an example, the yellow image forming unit 20 is described.

The LPH 21 includes an LED array, a driving IC, and a rod lens array. The LPH 21 performs exposure by allowing a number of LEDs to emit light toward the photosensitive drum 25 according to the control of exposure intensity by the controller 10.

The charging device 23 is configured of, for example, a conductive elastic roller. The charging device 23 charges the photosensitive drum 25 according to the potential control by the controller 10. Specifically, when a voltage is applied by allowing the charging device 23 to come in contact with the photosensitive drum 25, the photosensitive drum 25 is charged to have a positive polarity.

The photosensitive drum 25 is configured as a round column of aluminum having a photoconductor (for example, a-Si (amorphous silicon)) layer on its surface. The photosensitive drum 25 rotates with a center of its upper surface (or bottom surface) as its axis according to the control by the controller 10 (rotates to the left in FIG. 1). As described above, the photosensitive drum 25 is charged by the charging device 23, and when the LPH 21 emits light, the charge is removed from a portion which is scanned. Then, toner supplied from the developing device 27 described later is adhered to the photosensitive drum 25. As a result, the photosensitive drum 25 carries a toner image generated on the basis of image information.

The transferring roller 26 primarily transfers the toner image adhered to the photosensitive drum 25 to the intermediate transferring member 40. The transferring roller charges the intermediate transferring member 40 to be positive charge according to the control of transfer potential by the controller 10. As a result, toner adhered to the photosensitive drum 25 with a negative potential is transferred to the intermediate transferring member 40. As the transferring roller 26 rotates in the same direction as the photosensitive drum 25 (in FIG. 1, rotates to the right), the intermediate transferring member 40 is transferred so as to be pushed out in an arrow direction. However, when the toner remains on the photosensitive drum 25 after the primary transfer, the toner is scraped off by the cleaning blade 22 that comes in contact with the photosensitive drum 25.

The developing device 27 includes a cylinder of aluminum (hereinafter, referred to as a developing roll) having a magnet (magnet roll) therein. The developing device 27 is supplied with the toner from the toner cartridge 35 through the dispenser 29. The toner cartridge 35 is mounted so as to be able to be attached to or detached from the toner cartridge receiving portion 36. The supplied toner is agitated with a carrier and is negatively charged. A powder supplied for development like the toner and the carrier is called a developer. The developer is made into a magnetic brush shape on the developing roll by magnetic force of the magnet roll and brought into contact with the photosensitive drum 25. In addition, the toner on the developing roll is developed onto the photosensitive drum 25 according to the potential control by the controller 10 of the developing device 27. Accordingly, a toner image is formed on the photosensitive drum 25 and the toner image is primarily transferred to the intermediate transferring member 40.

As described above, as well as a yellow toner image, magenta, cyan, and black toner images are primarily transferred to the intermediate transferring member 40. Individually or in an overlapped state, the color toner images form an image. When the toner images are overlapped, the intermediate transferring member 40 is driven, and for example, on a part where the yellow toner image is primarily transferred, magenta and cyan toner images are primarily transferred and a color image is formed.

The intermediate transferring member 40 is continuously driven after the toner images are primarily transferred, and the primarily transferred part reaches the secondary transferring device 50. The secondary transferring device 50 secondary transfers the toner image primarily transferred to the intermediate transferring member 40 to a recording medium 60. The recording medium 60 includes film containing polyester as well as recording paper.

The secondary transferring device 50 charges the recording medium 60 to be positive charge according to the control of the transfer potential by the controller 10. As a result, the toner image with the negative potential which is adhered to the intermediate transferring member 40 is absorbed into the recording medium 60. The toner image absorbed into the recording medium 60 is fixed to the recording medium 60 by a fixing device (not shown).

The input unit 70 is configured of, for example, an operation panel or an operation button. When a user of the image forming apparatus 100 inputs content to the input unit 70, the input unit 70 outputs a signal to the controller 10 according to the input content.

Figure 2:
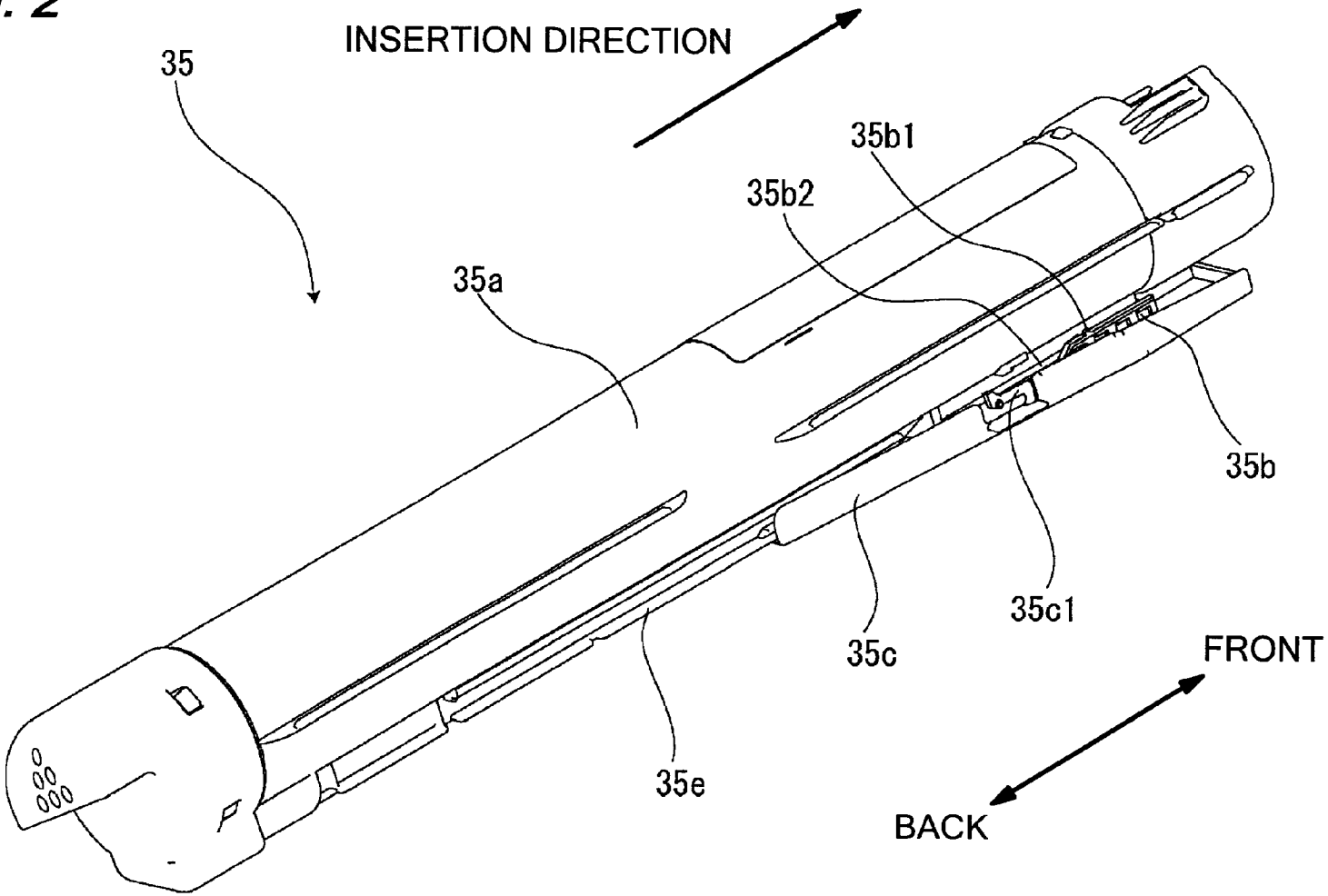
FIG. 2 is a perspective view illustrating an example of a toner cartridge.

Next, the toner cartridge 35 will be described in detail with reference to FIGS. 2 to 4. FIG. 2 is a perspective view illustrating an example of the toner cartridge 35. A forward side of the toner cartridge is defined as the same side where the toner cartridge is inserted into the image forming apparatus 100.

The toner cartridge 35 includes a container body 35*a*, covers 35*b* and 35*c*, and a guide piece 35*e*. The cover 35*b* (hereinafter, referred to as a shutter 35*b*) is provided on an outer surface of the cylindrical container body 35*a*. More specifically, the shutter 35*b* is provided on a bottom surface of a front part of the container body 35*a*. The shutter 35*b* is mounted to the guide piece 35*b*2 and thus is able to slide in an axial direction along an outer surface thereof. The shutter 35*b* slides along the guide piece 35*b*2 to open or close an opening portion (not shown) provided on the outer surface of the container body 35*a*. In FIG. 2, a state where the shutter 35*b* closes the opening portion is illustrated.

A side portion of the shutter 35*b* is provided with a protrusion 35*b*1 protruding toward an upper side of the container body 35*a*. The protrusion 35*b*1 may be provided on both sides instead of on only one side as illustrated in FIG. 2. The protrusion 35*b*1 comes in contact with a suspension protrusion 35*c*2 (see FIG. 5) which is provided on an inner surface of the side portion of the cover 35*c* and will be described later.

A shape of the side portion of the shutter 35*b* is a right-angled trapezoid, and a length of a lower bottom thereof is greater than that of an upper bottom thereof. Since the shape of the side portion of the shutter 35*b* is the right-angled trapezoid, a part connecting one end of the upper bottom to one end of the lower bottom forms right angles with the upper bottom and the lower bottom. However, a part connecting the other end of the upper bottom to the other end of the lower bottom has an inclination and does not form a right angle. The suspension protrusion 35*c*2 described above slides on the inclined portion and the part of the upper bottom connected from the inclined portion and stops by coming in contact with the protrusion 35*b*1 when the toner cartridge 35 is inserted into the image forming apparatus 100.

The cover 35*c* is suspended by the guide piece 35*e* provided on the outer surface of the container body 35*a*. The cover 35*c* slides and encloses the shutter 35*b*, while not coming in contact with a bottom portion of the shutter 35*b* and having space between the cover 35*c* and the bottom portion of the shutter 35*b*, when the container body 35*a* is pulled out from the image forming apparatus 100.

The guide piece 35*e* is provided on both sides of the bottom surface of the container body 35*a* and extends rearward from a center thereof. Suspension protrusions 35*c*3 and 35*c*4 (see FIG. 5), which are provided on an inner surface of the cover 35*c* and will be described later, slide along the guide piece 35*e*. Accordingly, the cover 35*c* moves toward a front side or a rear side of the container body 35*a*.

Center portions of both sides of the cover 35*c* are provided with pressed mechanisms 35*c*1. As the pressed mechanism 35*c*1 is pressed downward, the cover 35*c* is inclined so that its front end portion faces downward. The pressed mechanism 35*c*1 is bent downward when pressed and will return to its original state by a restoring force.

A bottom surface of the cover 35*c* is not horizontal and a front end portion 35*c*6 thereof is inclined. More specifically, a height of the front end portion of the cover 35*c* is lower than height of the center portion and of the rear end portion of the cover 35*c*. Although this will be described later in detail, when the bottom surface of the cover 35*c* is horizontal, in order to prevent a bottom surface of the toner cartridge receiving portion 36 from coming in contact with the bottom surface of the cover 35*c*, a distance from the toner cartridge 35 to the toner cartridge receiving portion 36 needs to be increased. However, by providing the inclined front end portion of the cover 35*c*, the distance between the toner cartridge 35 and the toner cartridge receiving portion 36 is reduced while preventing the contacting as mentioned above, and a large installation space for the toner cartridge 35 and the toner cartridge receiving portion 36 is not required in the image forming apparatus 100.

Figure 3:
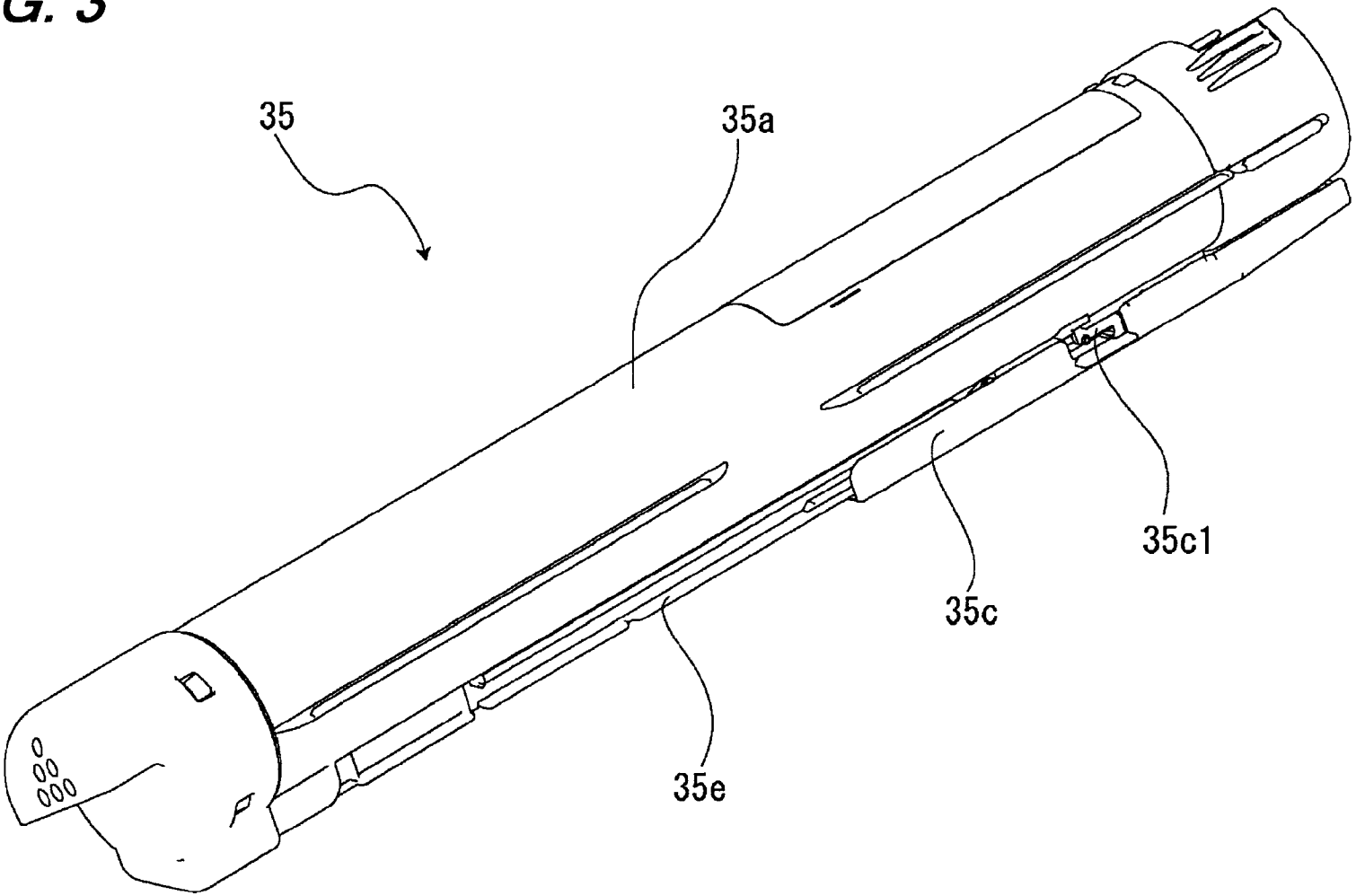
FIG. 3 is a perspective view illustrating the toner cartridge in a state in which a shutter is enclosed by a cover.

FIG. 3 is a perspective view illustrating the toner cartridge 35 in a state in which the shutter 35*b* is enclosed by the cover 35*c*.

When the user disengages the toner cartridge 35 from the image forming apparatus 100, a state illustrated in FIG. 3 is shown. As illustrated in FIG. 3, the cover 35*c* is positioned on the front side of the container body 35*a*. In addition, the front end portion of the cover 35*c* is aligned at substantially the same position as a front end portion of the container body 35*a*.

Figure 4:
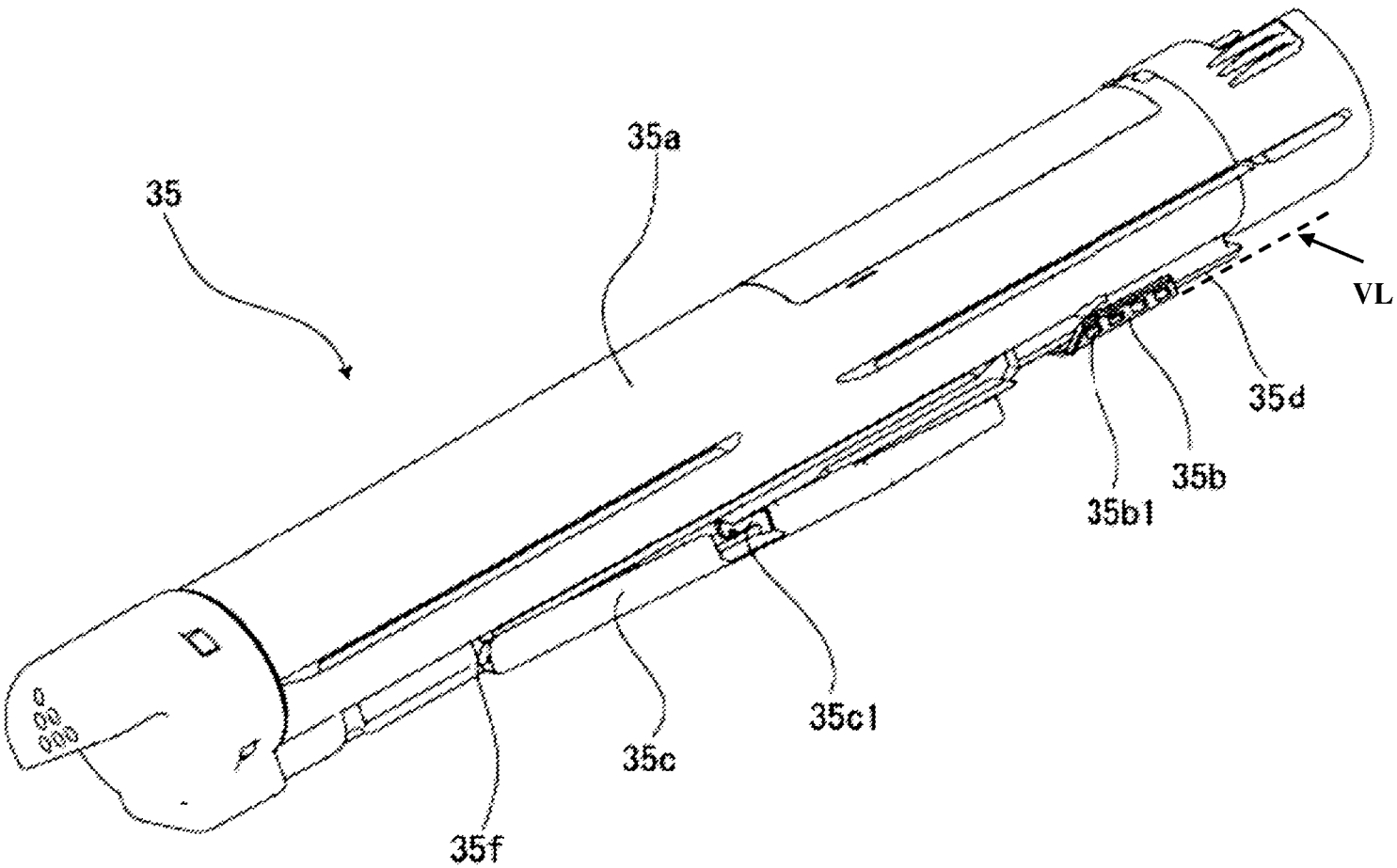
FIG. 4 is a perspective view illustrating the toner cartridge in a state in which the shutter is not enclosed by the cover.

The shutter 35*b* is enclosed by the cover 35*c* after crossing the virtual line VL shown in FIG. 4. As a result, even when toner is adhered to the shutter 35*b*, the toner is enclosed by the cover 35*c*, and the possibility that the toner adheres to the user is reduced. Moreover, when a color of the cover 35*c* is opaque, the shutter 35*b* is not visible to the user. As a result, even if yellow, cyan, and magenta toner is adhered to the shutter 35*b*, an unsightly appearance of the shutter 35*b* stained by the color toners is prevented.

FIG. 4 is a perspective view illustrating the toner cartridge 35 in a state in which the shutter 35*b* is not enclosed by the cover 35*c*. When the user inserts the toner cartridge 35 into the image forming apparatus 100 and the mounting of the toner cartridge 35 to the toner cartridge receiving portion 36 is completed, a state illustrated in FIG. 4 is shown. As illustrated in FIG. 4, the cover 35*c* is positioned on a rear side of the center portion of the container body 35*a*. In addition, the shutter 35*b* slides toward the rear side of the container body 35*a* to open an opening portion 35*d*. As a result, the toner contained in the container body 35*a* is supplied to the image forming apparatus 100.

A vicinity of an edge of the opening portion 35*d* is provided with a rubber plate (not shown). Accordingly, the shutter 35*b* comes in close contact with the opening portion 35*d* when the opening portion 35*d* is closed and exerts a strong pressing force on the opening portion 35*d*. In addition, since the shutter 35*b* comes in close contact with the rubber plate, when the shutter 35*b* slides, a force greater than friction between the rubber plate and the shutter 35*b* is needed. On the other hand, a pressing force of the cover 35*c* on the container body 35*a* is weaker than the pressing force of the shutter 35*b* on the opening portion 35*d*. Accordingly, when the cover 35*c* slides, a force sufficient enough to slide the shutter 35*b* is not needed.

Next, the cover 35*c* will be described in detail with reference to FIG. 5.

Figure 5:
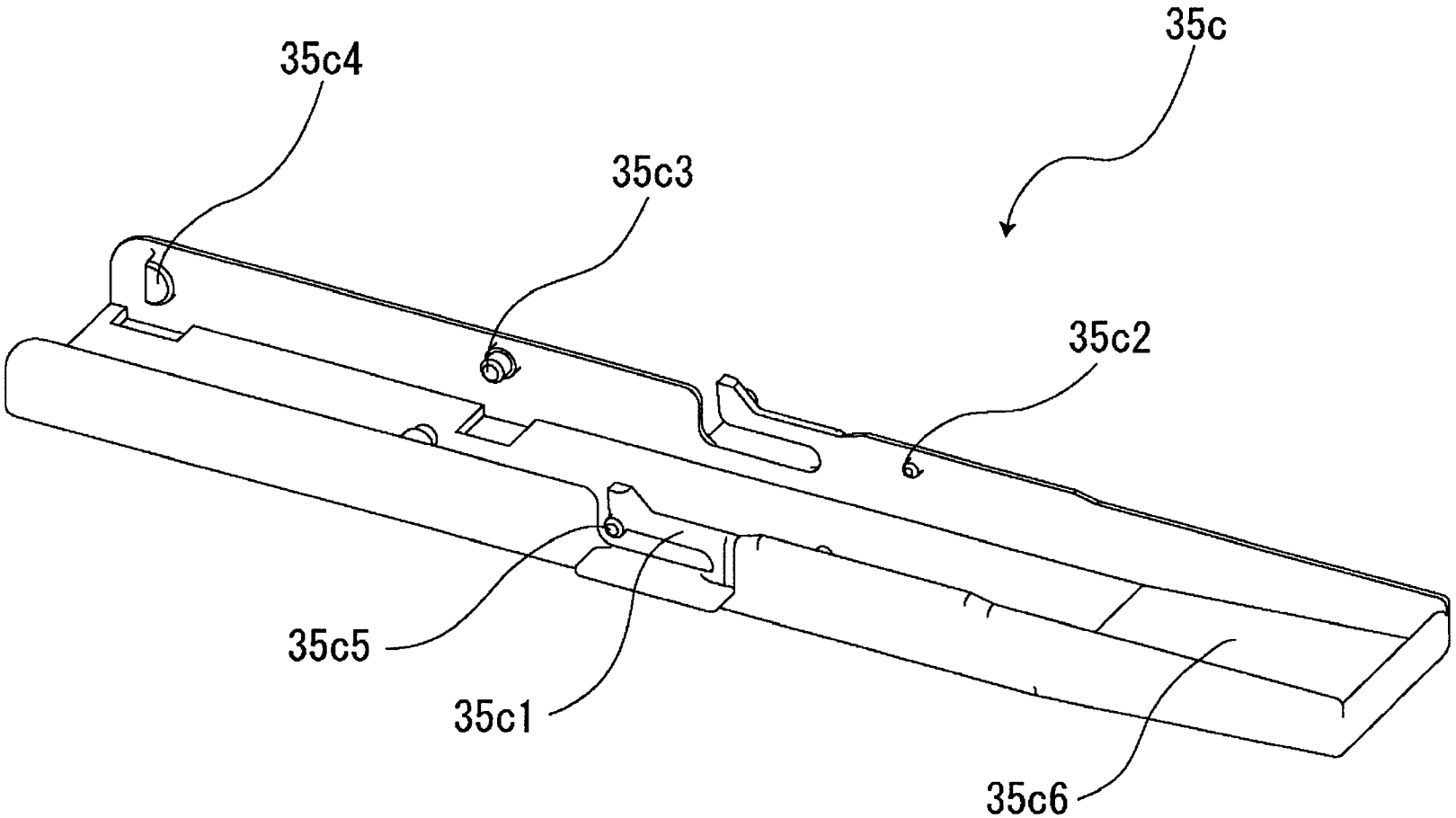
FIG. 5 is a perspective view illustrating the cover.

FIG. 5 is a perspective view illustrating the cover 35*c*. Both side portions of the cover 35*c* are provided with the suspension protrusions 35*c*2, 35*c*3, and 35*c*4. The suspension protrusion 35*c*2 is provided in front of the pressed mechanism 35*c*1. The suspension protrusion 35*c*4 is provided in the rear of the pressed mechanism 35*c*1. The suspension protrusion 35*c*3 is provided between the suspension protrusion 35*c*4 and the pressed mechanism 35*c*1. The suspension protrusions 35*c*2, 35*c*3, and 35*c*4 protrude toward an inside of the cover 35*c*.

The suspension protrusions 35*c*3 and 35*c*4 are connected to the guide piece 35*e* of the container body 35*a* described above. The suspension protrusion 35*c*2 is connected to both side portions of the shutter 35*b* described above. The cover 35*c* is suspended in the container body 35*a* by the suspension protrusions 35*c*2 and 35*c*4 or the suspension protrusions 35*c*3 and 35*c*4.

A vicinity of the center portions of the both sides of the cover 35*c* is provided with the pressed mechanism 35*c*1. A rear side of the pressed mechanism 35*c*1 is provided with a protrusion 35*c*5 protruding toward an outside of the cover 35*c*. A space exists between the pressed mechanism 35*c*1 and the cover 35*c*. Therefore, when the protrusion 35*c*5 is pressed downward, the pressed mechanism 35*c*1 is bent downward. The bent pressed mechanism 35*c*1 has a restoring force to return it to its original state. When the pressed mechanism 35*c*1 is bent downward, the cover 35*c* is inclined so that its front portion faces downward.

The opening portion 35*d* and the shutter 35*b* are accommodated in a space formed by side surfaces, the bottom surface, and a front surface of the cover 35*c*. The opening portion 35*d* and the shutter 35*b* are enclosed by the side surfaces, the bottom surface, and the front surface of the cover 35*c*. In addition, visibility of the opening portion 35*d* and the shutter 35*b* is blocked by the side surfaces, the bottom surface, and the front surface of the cover 35*c*.

Subsequently, the toner cartridge receiving portion 36 will be described in detail with reference to FIGS. 6 and 7.

Figure 6:
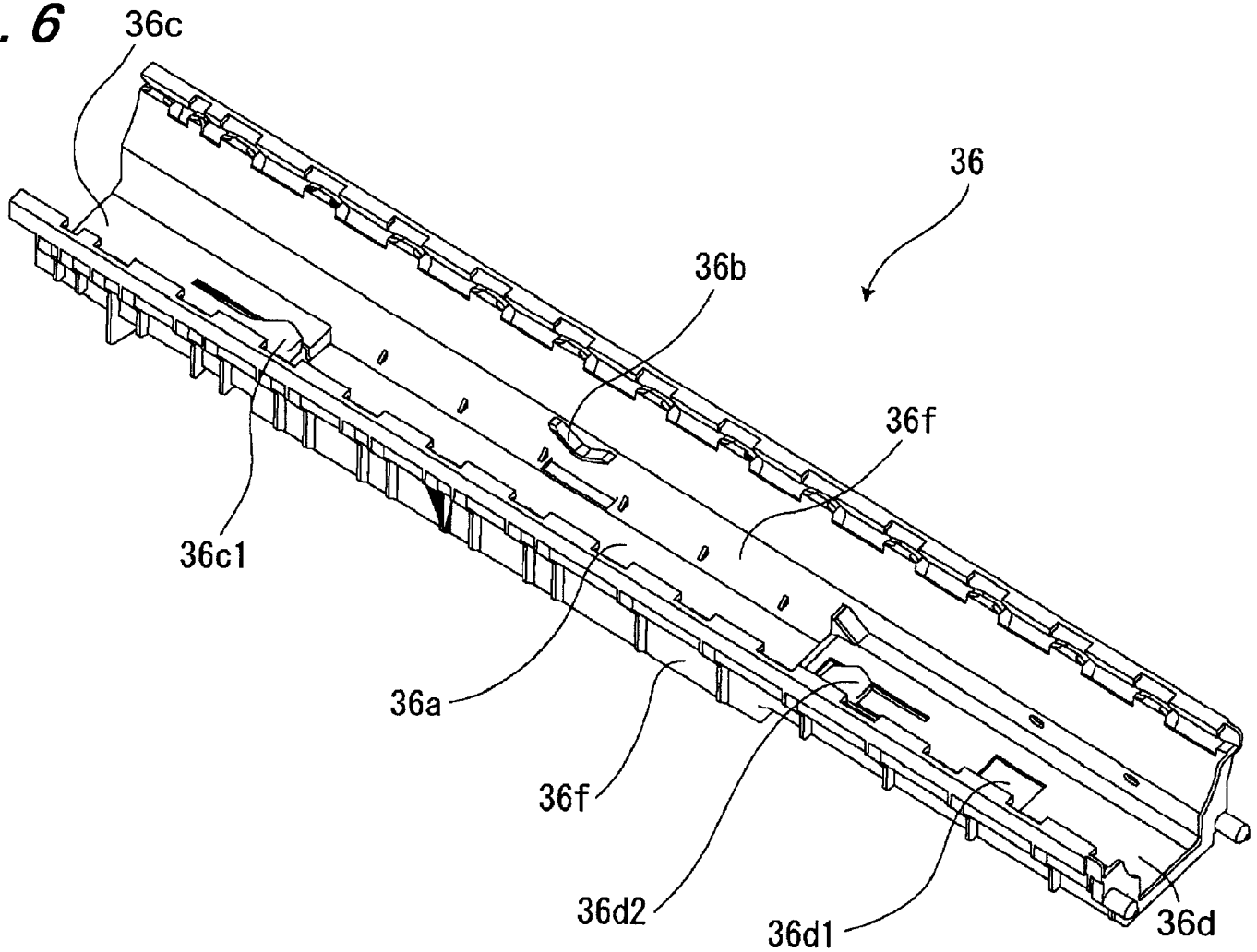
FIG. 6 is a perspective view illustrating a toner cartridge receiving portion.
Figure 7:
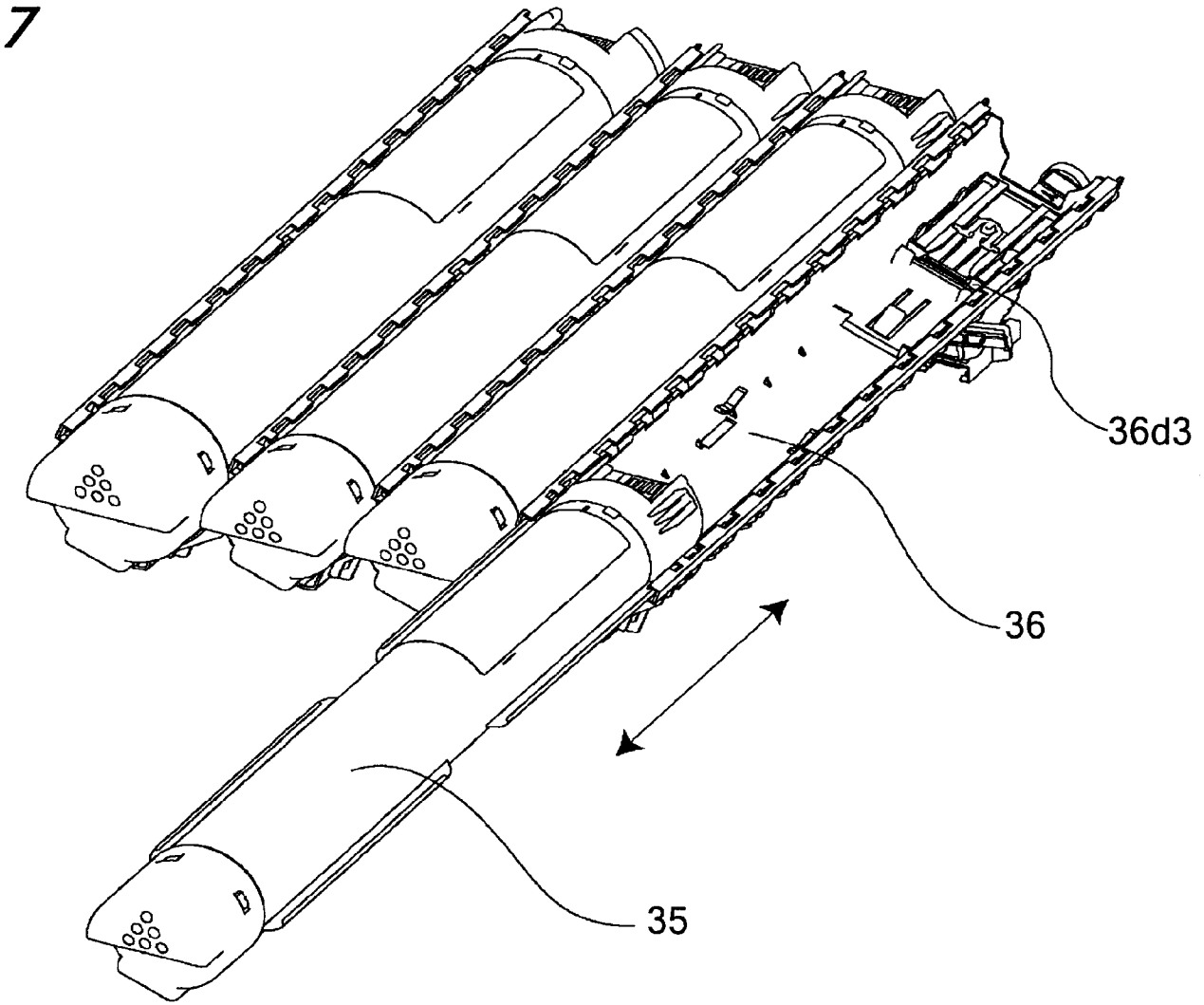
FIG. 7 is a perspective view illustrating the toner cartridge when it is mounted in the toner cartridge receiving portion.

FIG. 6 is a perspective view illustrating the toner cartridge receiving portion 36. FIG. 7 is a perspective view illustrating the toner cartridge 35 when it is mounted in the toner cartridge receiving portion 36. As illustrated in FIG. 6, the toner cartridge receiving portion 36 includes bottom surfaces 36*a*, 36*c*, and 36*d* and both side portions 36*f*.

The bottom surface 36*a* is interposed between the bottom surfaces 36*c* and 36*d*. The bottom surface 36*a* is formed at a position lower than that of the bottom surface 36*c*. The bottom surface 36*d* is formed at a position higher than that of the bottom surface 36*c*. Therefore, there are height differences between the bottom surfaces 36*a*, 36*c*, and 36*d*. In a space formed by the bottom surface 36*a* and side portions 36*f*, the cover 35*c* is accommodated when the toner cartridge 35 is mounted.

On the bottom surface 36*c*, a stopper 36*c*1 is formed so as to be able to slide. As illustrated in FIG. 7, when the toner cartridge 35 is pulled out from the toner cartridge receiving portion 36, the stopper 36*c*1 comes in contact with the rear end portion of the cover 35*c* to stop a movement of the cover 35*c* movable along with the container body 35*a*. In this state, when the toner cartridge 35 is further pulled out, the cover 35*c* is moved to a relatively forward side of the container body 35*a*. Accordingly, the cover 35*c* encloses the shutter 35*b* and the opening portion 35*d*.

A pressing mechanism 36*b* is formed on an inner side of the side portion 36*f* with the bottom surface 36*a* interposed therebetween. The pressing mechanisms 36*b* are formed on the both side portions 36*f*. The pressing mechanism 36*b* has a V shape in which an apex faces the bottom surface 35*a*. The pressing mechanism 36*b* presses the protrusion 35*c*5 provided in the pressed mechanism 35*c*1 of the cover 35*c*. As illustrated in FIG. 7, when the toner cartridge 35 is inserted, the protrusion 35*c*5 of the cover 35*c* is pressed by a predetermined pressing force at an inlet of the pressing mechanism 36*b*. The pressing force is increased as the protrusion 35*c*5 descends along an inclined surface of the pressing mechanism 36*b* such that the pressing force is greatest at the apex of the pressing mechanism 36*b*. When the protrusion 35*c*5 is pressed, the cover 35*c* is inclined.

The bottom surface 36*d* is provided with a discharge port 36*d*1 and a stopper 36*d*2. A position of the discharge port 36*d*1 is closer to the rear end portion of the toner cartridge receiving portion 36 than a position of the stopper 36*d*2.

The discharge port 36*d*1 is positioned to be aligned with the position of the opening portion 35*d* of the container body 35*a* when the mounting of the toner cartridge 35 is completed. Therefore, the toner accommodated in the container body 35*a* is supplied to the image forming apparatus 100 through the opening portion 35*d* and the discharge port 36*d*1.

The stopper 36*d*2 comes in contact with the rear end portion of the shutter 35*b* when the toner cartridge 35 is pulled out and stops a movement of the shutter 35*b* which corresponds with that of the container body 35*a*. In this state, when the toner cartridge 35 is further pulled out, the shutter 35*b* moves to a relatively forward side of the container body 35*a*. Accordingly, the shutter 35*b* closes the opening portion 35*d*.

Next, an insertion operation of the toner cartridge 35 will be described with reference to FIGS. 8 to 11.

Figure 8:
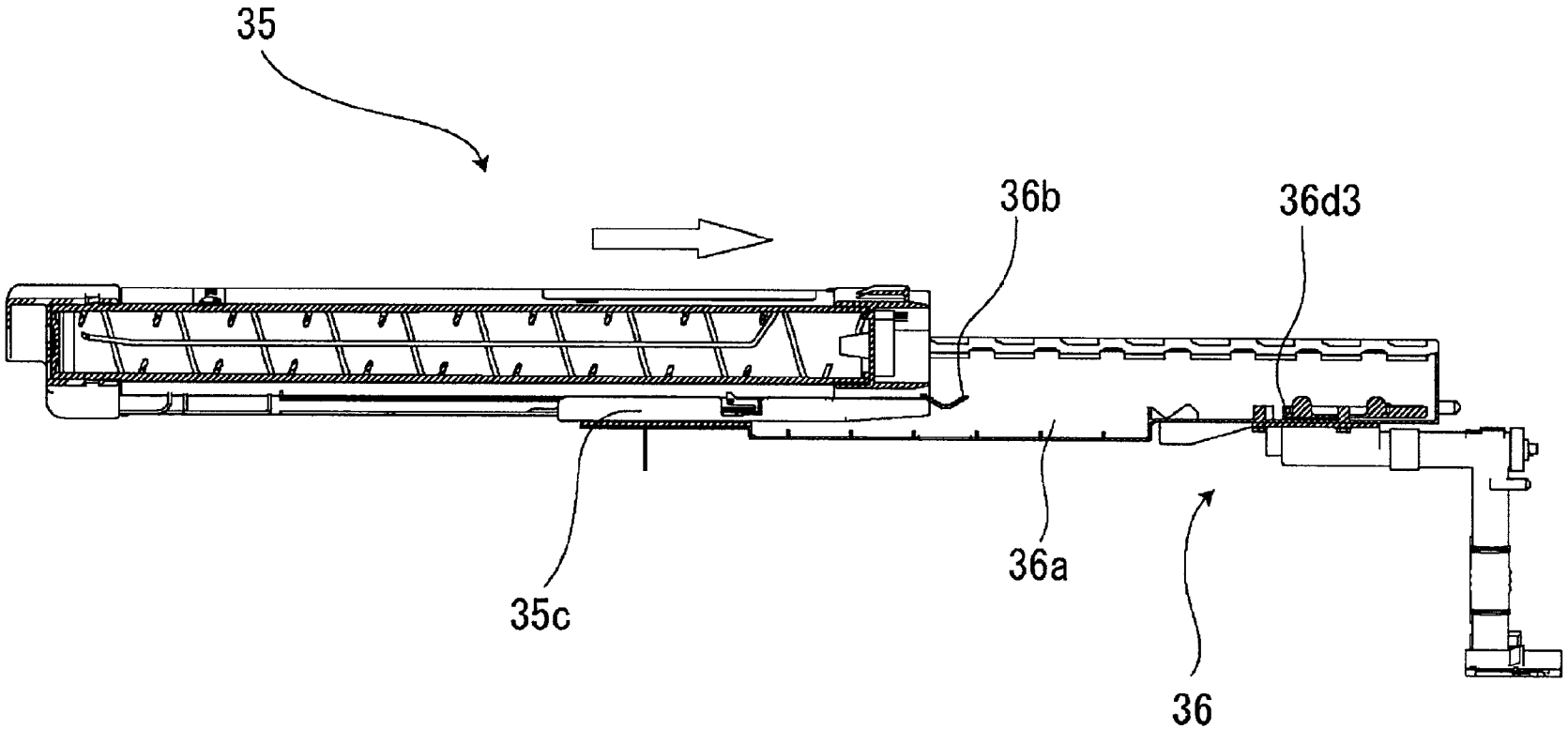
FIG. 8 is a cross-sectional view illustrating the toner cartridge at the time of starting insertion.
Figure 9:
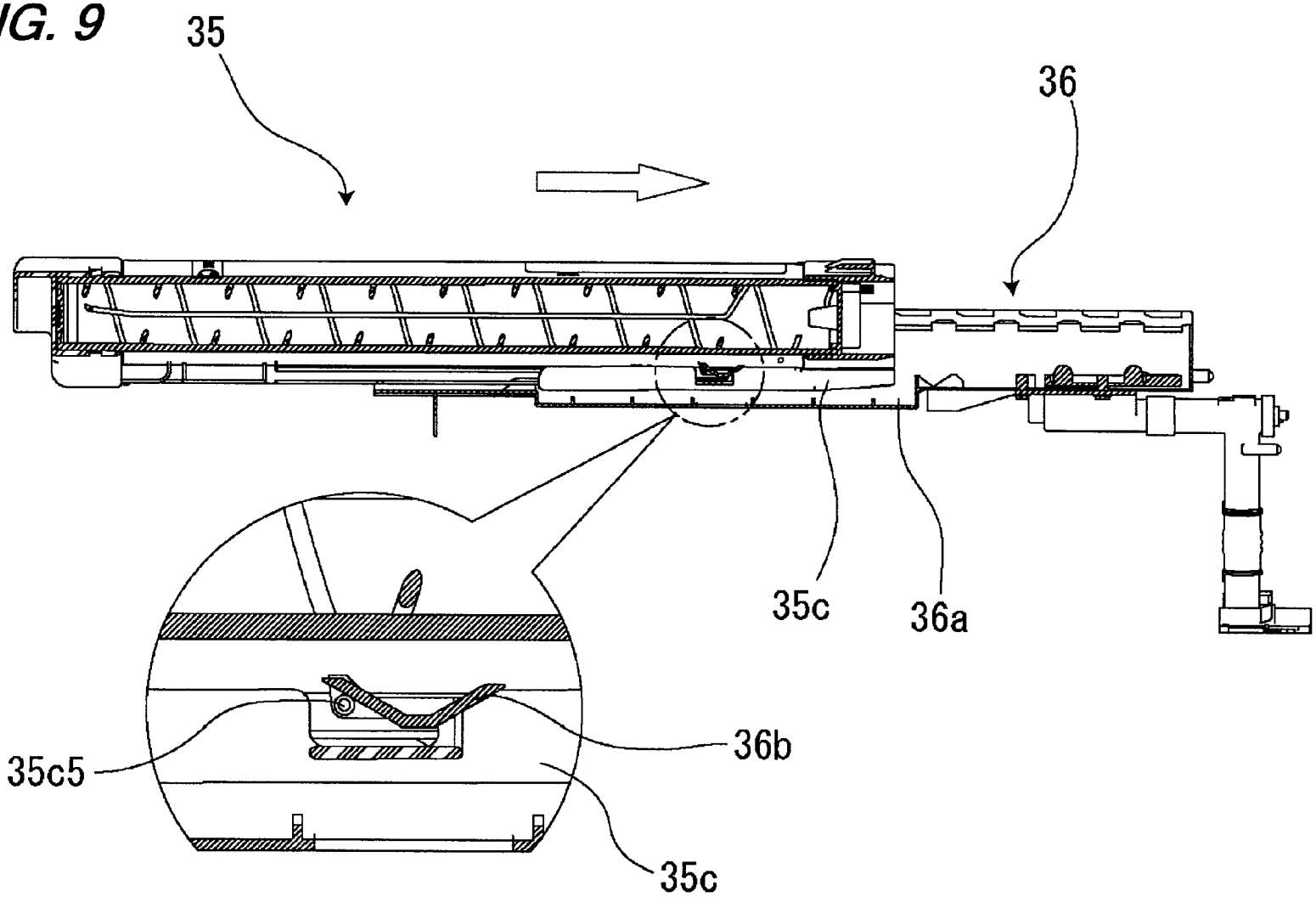
FIG. 9 is a cross-sectional view illustrating the toner cartridge during the insertion.
Figure 10:
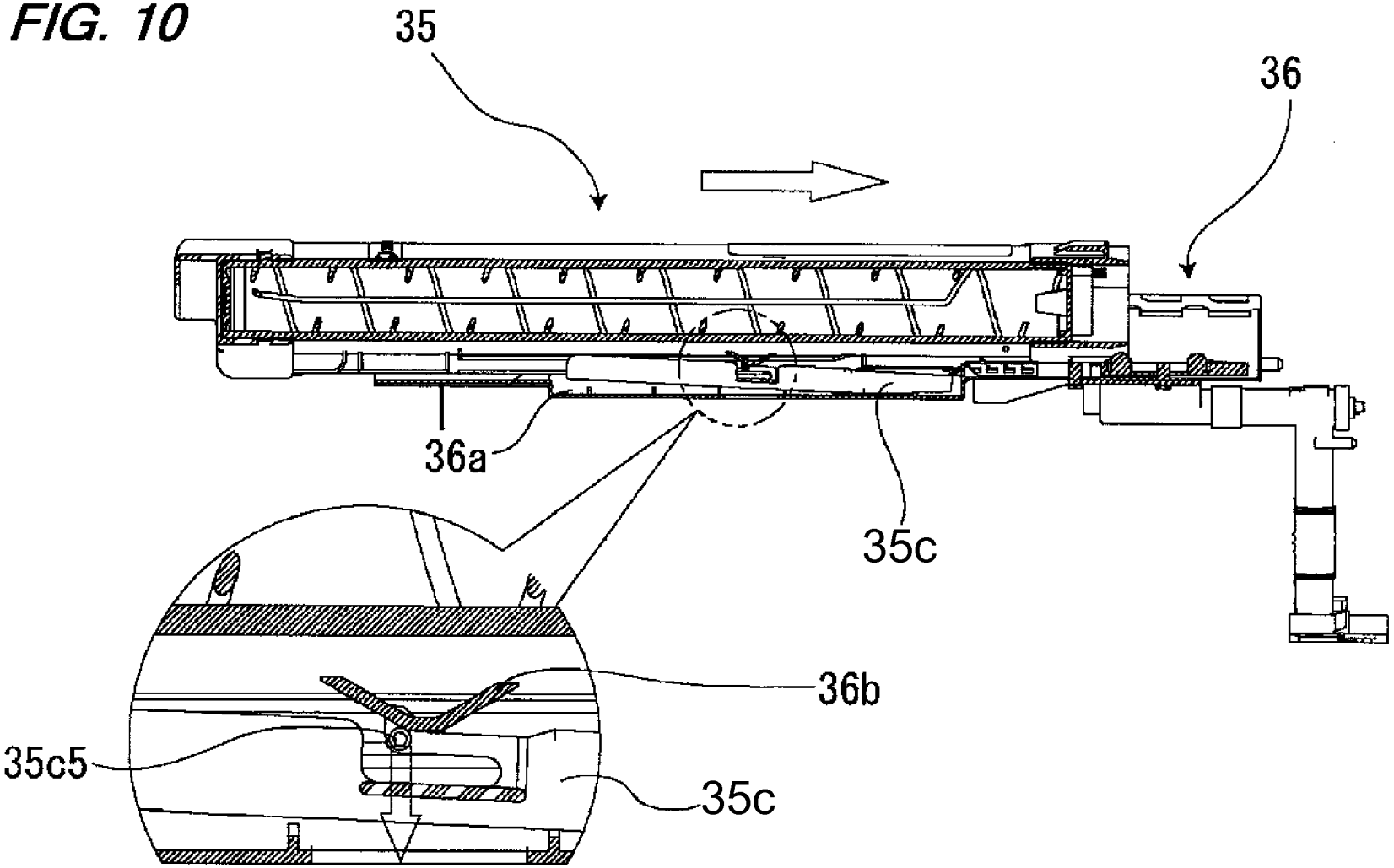
FIG. 10 is a cross-sectional view illustrating the toner cartridge during the insertion.
Figure 11:
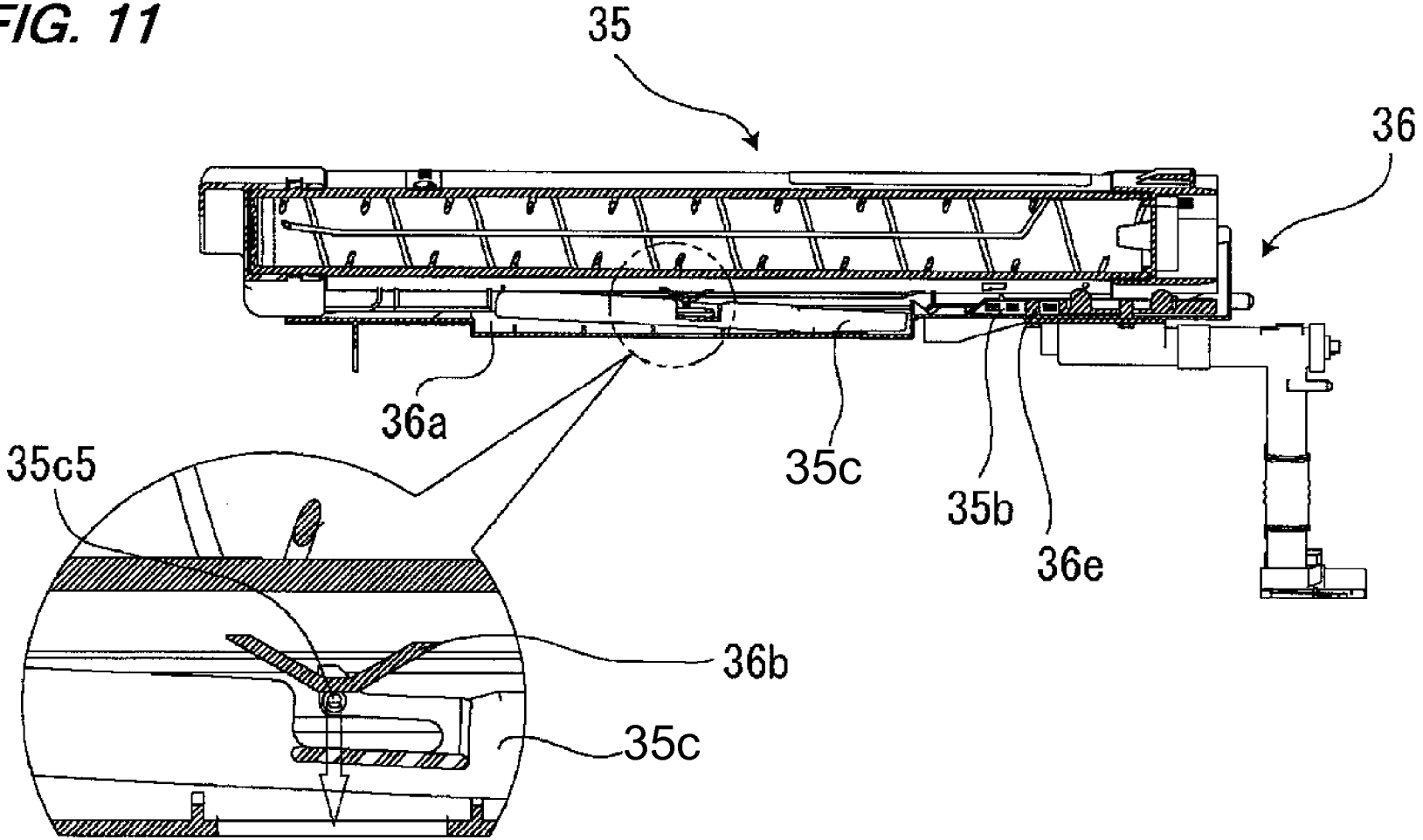
FIG. 11 is a cross-sectional view illustrating the toner cartridge when the insertion has been completed.

FIG. 8 is a cross-sectional view illustrating the toner cartridge 35 at the time of starting insertion. FIGS. 9 and 10 are cross-sectional views illustrating the toner cartridge 35 during the insertion. FIG. 11 is a cross-sectional view illustrating the toner cartridge 35 when the insertion has been completed.

As illustrated in FIG. 8, the toner cartridge 35 is inserted while staying horizontal. When the insertion is started, the center portion and the rear end portion of the bottom surface of the cover 35*c* move forward while maintaining a state of substantially being parallel to the bottom surface 36*c* of the toner cartridge receiving portion 36.

When the toner cartridge 35 is further inserted from the state illustrated in FIG. 8, as illustrated in FIG. 9, the protrusion 35*c*5 comes in contact with the pressing mechanism 36*b*. When the toner cartridge 35 is still further inserted, as illustrated in FIG. 10, the protrusion 35*c*5 is pressed downward, and the pressed mechanism 35*a*1 is bent. Accordingly, the cover 35*c* is inclined so that its front end portion faces downward and starts to be accommodated in a space which includes the bottom surface 36*a*. Here, the bottom surface of the front end portion of the cover 35*c* is formed so that an angle between the bottom surface of the front end portion thereof and the bottom surface 36*a* of the toner cartridge receiving portion 36 is reduced when the bottom surface of the front end portion of the cover 35*c* is inclined as the protrusion 35*c*5 is pressed downward by the pressing mechanism 36*b*. Therefore, the height difference between the bottom surfaces 36*a* and 36*c* or the height difference between the bottom surfaces 36*a* and 36*d* may be smaller as compared with a case where the bottom surface of the cover 35*c* is horizontal.

When the toner cartridge 35 is further inserted from the state illustrated in FIG. 10, the suspension protrusion 35*c*4 provided in the cover 35*c* comes in contact with the protrusion 35*f* (see FIG. 4) provided in the container body 35*a* and the forward movement of the toner cartridge receiving portion 36 is stopped. The container body 35*a* and the shutter 35*b* provided therein move toward the front side of the toner cartridge receiving portion 36 as illustrated in FIG. 11. As described above, since the shutter 35*b* moves along with the movement of the container body 35*a* while the front end portion of the cover 35*c* is facing downward, a collusion of the shutter 35*b* with the cover 35*c* is prevented.

The shutter 35*b* opens the opening portion 35*d* as the toner cartridge 35 is inserted. This is because the shutter 35*b* comes in contact with an embankment 36*d*3 (see FIGS. 7 and 8) provided between the stopper 36*d*2 and the discharge port 36*d*1 and the movement of the shutter 35*b* in the insertion direction is stopped. When the toner cartridge 35 is inserted and the shutter 35*b* is to be opened, slight vibration may occur. Therefore, the toner accommodated in the vicinity of the opening portion 35*d* falls to the bottom surface 36*d* of the toner cartridge receiving portion 36. Accordingly, there is a concern that the toner may adhere to the front end portion of the shutter 35*b* or the front end portion of the rubber plate. The toner may still be adhered when the toner cartridge 35 is pulled out, and there is a possibility that the toner adheres to the clothes or the body of a user. However, when the toner cartridge 35 is pulled out, the shutter 35*b* is enclosed by the cover 35*c*. Therefore, the possibility that the toner adheres to the clothes or the body of the user is suppressed, and the toner is not visible to the user. In addition, the pulling out of the toner cartridge 35 is performed by reversing the order illustrated in FIGS. 8 to 11.

Operations of the cover 35*c* shown when the toner cartridge 35 is further inserted are described with reference to FIGS. 12 to 15.

Figure 12:
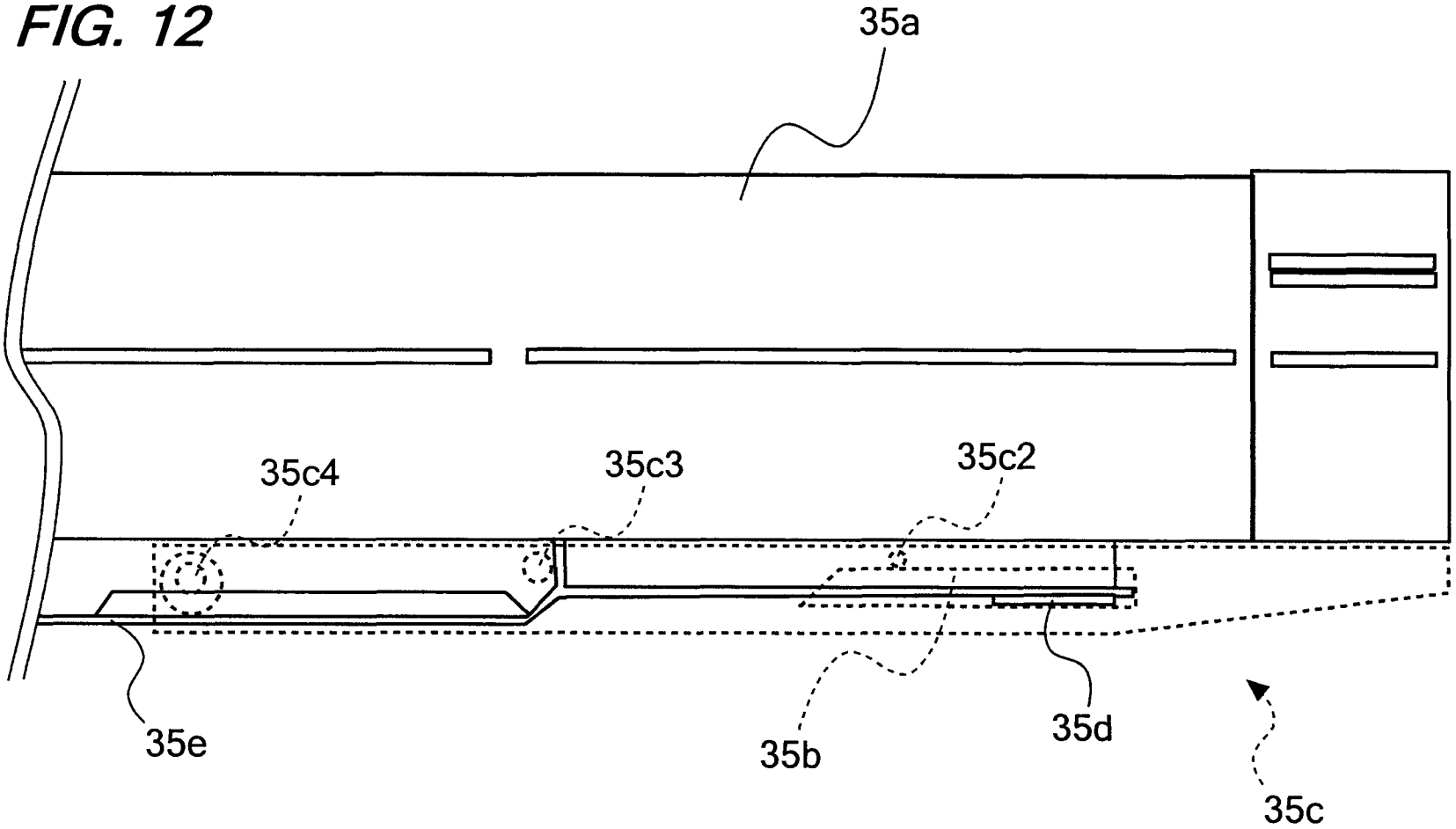
FIG. 12 is a side view illustrating the cover of the toner cartridge at the time of starting the insertion.
Figure 13:
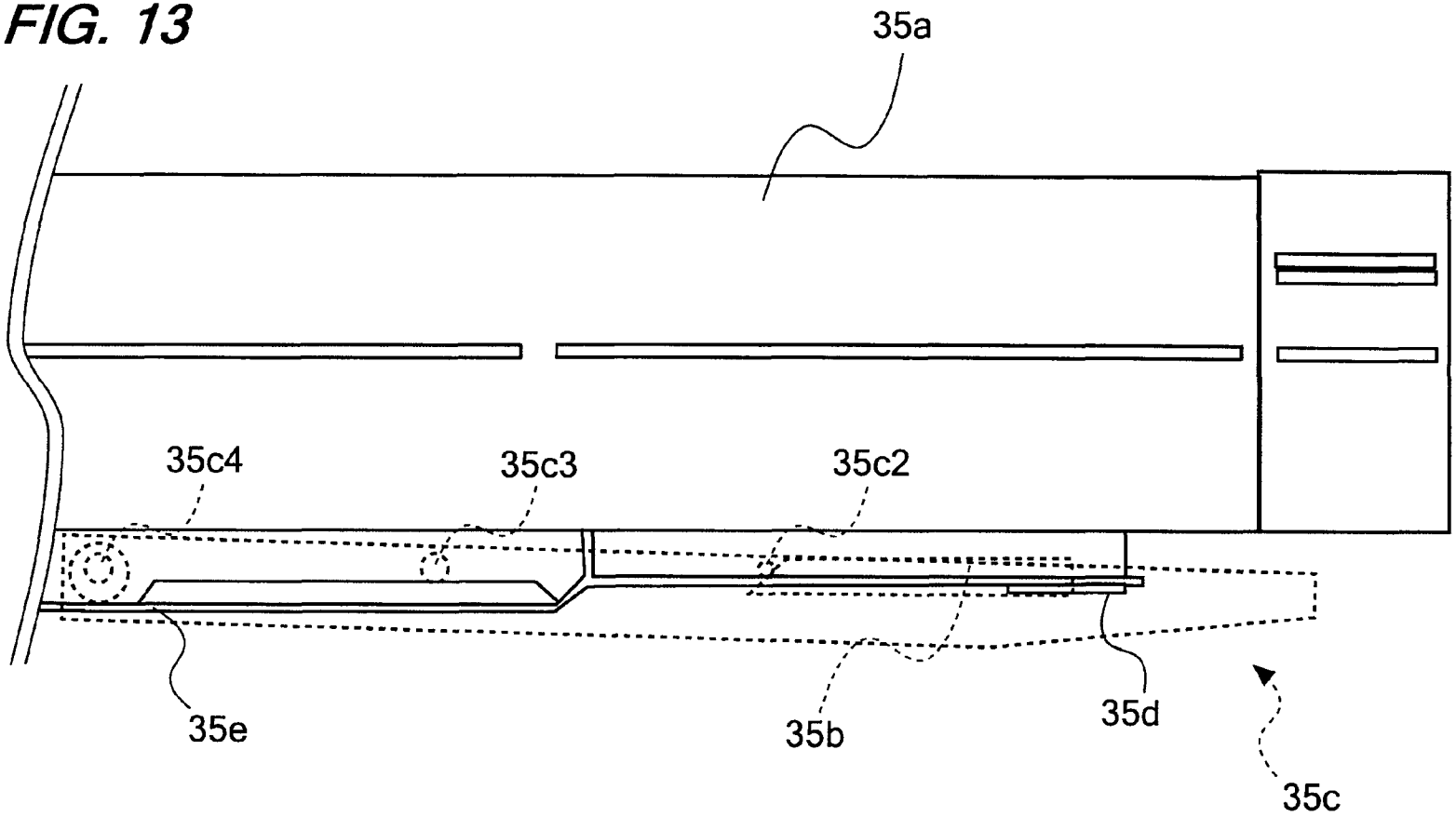
FIG. 13 is a side view illustrating the cover of the toner cartridge during the insertion.
Figure 14:
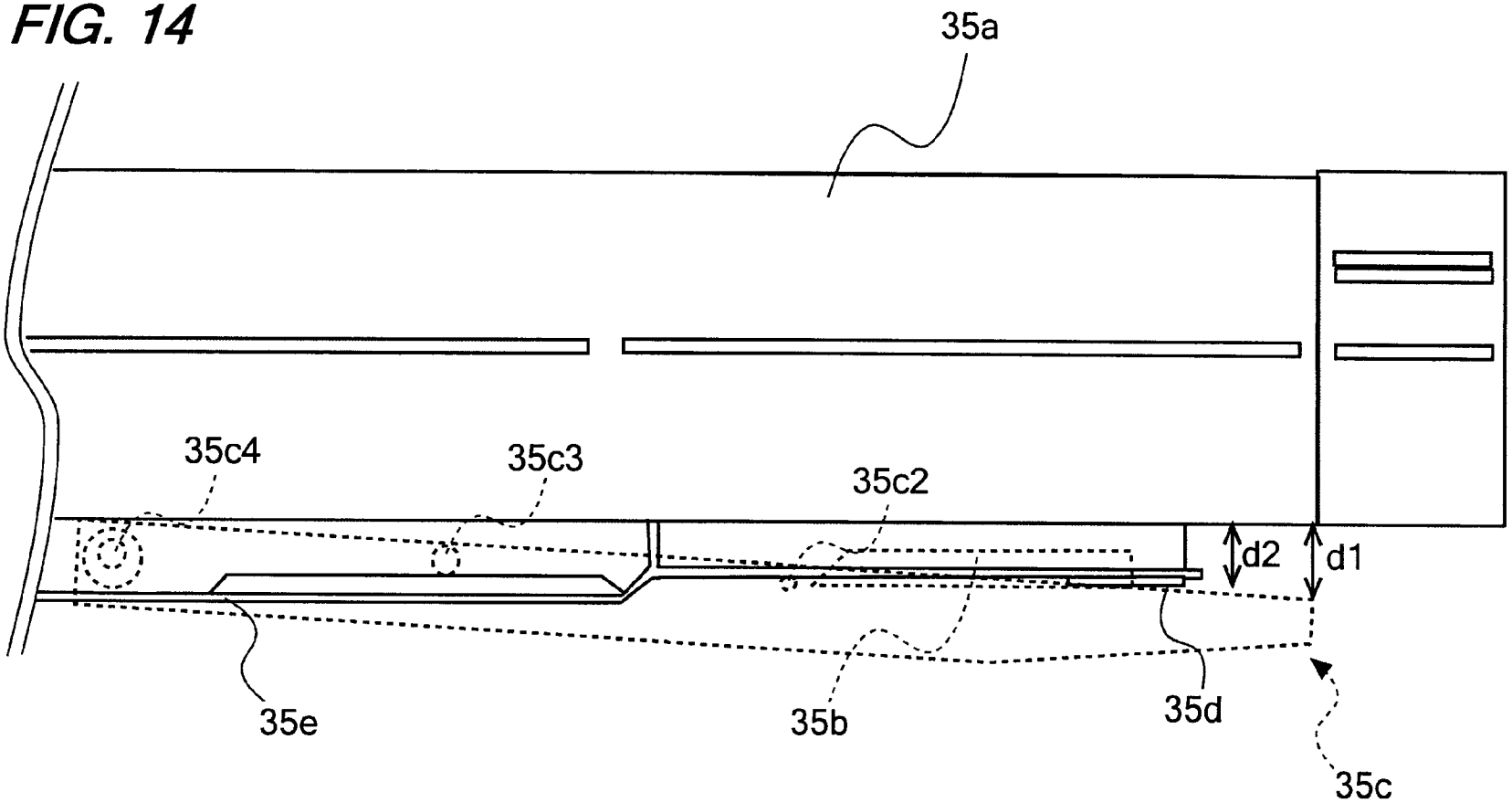
FIG. 14 is a side view illustrating the cover of the toner cartridge during the insertion.
Figure 15:
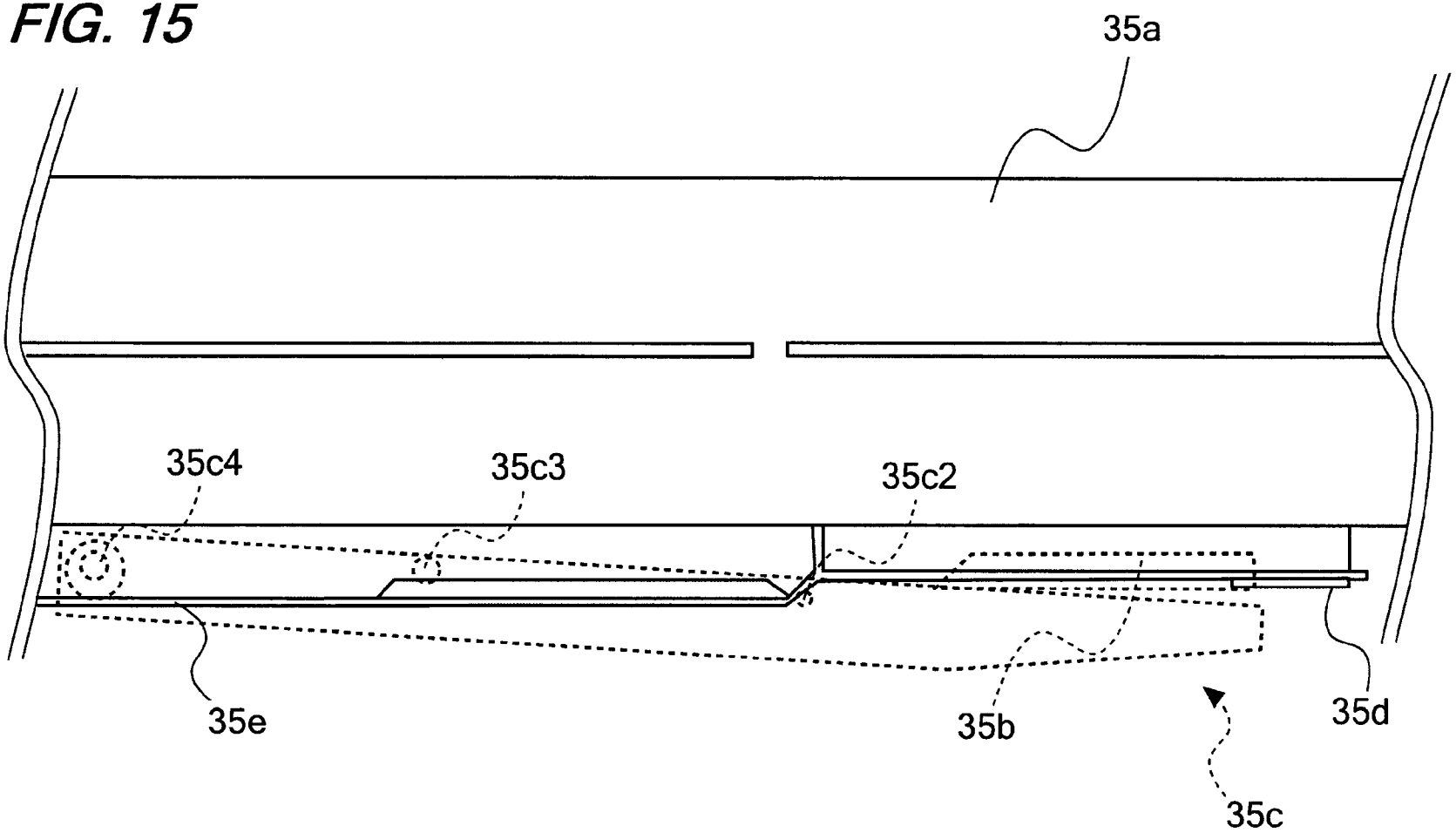
FIG. 15 is a side view illustrating the cover of the toner cartridge during the insertion.

FIG. 12 is a side view illustrating the cover 35*c* of the toner cartridge 35 at the time of starting the insertion. FIGS. 13 to 15 are side views illustrating the cover 35*c* of the toner cartridge 35 during the insertion.

As illustrated in FIG. 12, the suspension protrusion 35*c*2 of the cover 35*c* comes in contact with an upper side of the side portion of the shutter 35*b* at the time of starting the insertion of the toner cartridge 35, and the suspension protrusion 35*c*4 thereof comes in contact with the guide piece 35*e*. That is, the cover 35*c* is suspended at two points of the suspension protrusions 35*c*2 and 35*c*4. Here, the shutter 35*b* closes the opening portion 35*d*.

When the toner cartridge 35 is inserted, as illustrated in FIG. 13, the suspension protrusion 35*c*2 moves the side portion of the shutter 35*b* toward a relatively rearward side of the container body 35*a*, and the suspension protrusion 35*c*4 moves the guide piece 35*e* toward a relatively rearward side of the container body 35*a*. In addition, the suspension protrusion 35*c*3 moves toward a relatively rearward side of the container body 35*a* on a trapezoidal convex portion provided on the guide piece 35*e*. Therefore, the cover 35*c* is suspended at three points of the suspension protrusions 35*c*2, 35*c*3, and 35*c*4. Due to the suspended state, the cover 35*c* is inclined. Here, the shutter 35*b* slightly opens the opening portion 35*d*.

When the toner cartridge 35 is further inserted, as illustrated in FIG. 14, the suspension protrusion 35*c*2 slides and falls from the side portion of the shutter 35*b* and is suspended. The suspension protrusion 35*c*4 moves toward a relatively rearward side of the container body 35*a* along the guide piece 35*e*. In addition, the suspension protrusion 35*c*3 moves toward a relatively rearward side of the container body 35*a* on the trapezoidal convex portion provided on the guide piece 35*e*. Therefore, the cover 35*c* is suspended at two points of the suspension protrusions 35*c*3 and 35*c*4. In this suspended state, the cover 35*c* is inclined. Here, the shutter 35*b* further opens the opening portion 35*d* as compared with the state illustrated in FIG. 13.

In this state, a distance d1 between the upper side of the front end portion of the cover 35*c* and the bottom portion of the container body 35*a* is greater than a distance d2 between the bottom portion of the container body 35*a* and the bottom surface of the shutter 35*b*. Accordingly, the front surface of the cover 35*c* is prevented from coming in contact with the bottom surface of the shutter 35*b* or the opening portion 35*d* even though the cover 35*e* moves toward a relatively rearward side of the container body 35*a*. Therefore, the pressed mechanism 35*c*1 needs to be pressed at least to an extent equal to or greater than the distance between the bottom surface of the shutter 35*b* and the bottom portion of the container body 35*a*.

When the toner cartridge 35 is further inserted, as illustrated in FIG. 15, the suspension protrusion 35*c*4 moves along the guide piece 35*e* toward the relatively rearward side of the container body 35*a*. In addition, the suspension protrusion 35*c*3 moves toward the relatively rearward side of the container body 35*a* on the trapezoidal convex portion provided in the guide piece 35*e*. In this suspended state, the cover 35*c* is inclined. Here, the shutter 35*b* opens the opening portion 35*d*. In addition, the cover 35*c* is not under the opening portion 35*d*. Therefore, when the insertion of the toner cartridge 35 is completed, the toner is supplied to the image forming apparatus 100 through the opening portion 35*d*.

In addition, the pulling out of the toner cartridge 35 is performed by reversing the order illustrated in FIGS. 12 to 15 described above. Here, the shutter 35*b* is gradually closed as the toner cartridge 35 is pulled out. Here, when the shutter 35*b* is stopped in the course of the movement for any reason, a part of the opening portion 35*d* is opened. However, as the toner cartridge 35 is pulled out, the suspension protrusion 35*c*2 of the cover 35*c* ascends while being in contact with the inclined surface of the side portion of the shutter 35*b* and comes in contact with the protrusion 35*b*1 (see FIG. 2) provided in the upper part of the side portion thereof. In this state, when the toner cartridge 35 is further pulled out, the movement of the rear end portion of the cover 35*c* is stopped by the stopper 36*c*1, and the shutter 35*b* moves toward the relatively forward side of the container body 35*a* due to the suspension protrusion 35*c*2. As a result, the shutter 35*b* is closed completely, and completing the pulling out of the toner cartridge 35 when the opening portion 35*d* is opened is prevented.

While the invention has been described with reference to exemplary embodiments, it is to be understood that the invention is not limited to the disclosed exemplary embodiments, and various modifications can be made without departing from the spirit and scope of the invention disclosed in the following claims.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

What is claimed is:

1. A toner cartridge comprising:

a container body that contains toner and that has an opening portion provided on an outer face of the container body and a guide piece provided on the outer face;

a first cover that opens and closes the opening portion; and a second cover that is supported by the guide piece and configured to slide in a direction opposite to an insertion direction such that the leading edge of the second cover moves from a position closer to the container body than the first cover to a position further from the container than the first cover as the container body is inserted into an image forming apparatus.

2. The toner cartridge according to claim 1, wherein the second cover includes a pressed mechanism that inclines the second cover so that a front end portion of the second cover moves away from the container body by being pressed when the container body is inserted into the image forming apparatus.

3. The toner cartridge according to claim 2, wherein the pressed mechanism is pressed a given distance that is equal to or greater than a distance between a bottom face of the first cover and a bottom portion of the container body.

4. The toner cartridge according to claim 2, wherein the second cover is movable between an original position and an inclined position, and a position of the second cover is moved toward the original position by the guide piece when the container body is pulled out from the image forming apparatus when the second cover is inclined by the pressed mechanism.

5. The toner cartridge according to claim 1, wherein the first cover includes a first protrusion that is provided on a side portion of the first cover and that protrudes toward an upper side of the container body, the second cover includes a second protrusion that is provided on an inner side of a side portion of the second cover, and the second protrusion comes in contact with the first protrusion when the container body is pulled out from the image forming apparatus so that the first cover slides in an insertion direction of the container body.

6. The toner cartridge according to claim 1, wherein a pressing force of the second cover exerted on the container body is weaker than a pressing force of the first cover exerted on the opening portion.

7. An image forming apparatus comprising:

a toner cartridge that includes:

a container body that contains toner and that has an opening portion provided on an outer face of the container body and a guide piece provided on the outer face;

a first cover that opens and closes the opening portion; and a second cover that is supported by the guide piece and is configured to slide in a direction opposite to an insertion direction such that the leading edge of the second cover moves from a position closer to the container body than the first cover to a position further from the container than the first cover as the container body is inserted into an image forming apparatus;

a toner cartridge receiving portion that receives the toner cartridge, wherein the toner cartridge receiving portion includes a pressing mechanism that is configured to press a pressed mechanism.

8. The image forming apparatus according to claim 7, wherein a front end portion of a first bottom surface of the second cover is formed to be inclined so that an angle between the first bottom surface and a second bottom surface of the toner cartridge receiving portion is reduced when the first bottom surface is inclined as the pressed mechanism is pressed by the pressing mechanism.

9. The image forming apparatus according to claim 7, wherein the second cover includes a pressed mechanism that inclines the second cover so that a front end portion of the second cover moves away from the container bodyby being pressed when the container body is inserted into the image forming apparatus.

10. The toner cartridge according to claim 9, wherein the second cover includes a pressed mechanism that inclines the second cover so that a front end portion of the second cover moves away from the container body by being pressed when the container body is inserted into the image forming apparatus.

11. The image forming apparatus according to claim 9, wherein the second cover is movable between an original position and an inclined position, and a position of the second cover is moved toward the original position by the guide piece when the container body is pulled out from the image forming apparatus when the second cover is inclined by the pressed mechanism.

12. The image forming apparatus according to claim 7, wherein the first cover includes a first protrusion that is provided on a side portion of the first cover and that protrudes toward an upper side of the container body, the second cover includes a second protrusion that is provided on an inner side of a side portion of the second cover, and the second protrusion comes in contact with the first protrusion when the container body is pulled out from the image forming apparatus so that the first cover slides in an insertion direction of the container body.

13. A toner cartridge comprising:

a container body that contains toner and that has an opening portion provided on an outer face of the container body and a guide piece provided on the outer face;

a first cover that opens and closes the opening portion; and a second cover that is supported by the guide piece and is configured to slide in a direction opposite to an insertion direction such that the leading edge of the second cover moves from a position closer to the container body than the first cover to a position further from the container than the first cover as the container body is inserted into an image forming apparatus.

14. The image forming apparatus according to claim 9, wherein the pressed mechanism is pressed a given distance that is equal to or greater than a distance between a bottom face of the first cover and a bottom portion of the container body.

15. The toner cartridge according to claim 14, wherein the pressed mechanism is pressed a given distance that is equal to or greater than a distance between a bottom face of the first cover and a bottom portion of the container body.

16. The toner cartridge according to claim 14, wherein the second cover is movable between an original position and an inclined position, and a position of the second cover is moved toward the original position by the guide piece when the container body is pulled out from the image forming apparatus when the second cover is inclined by the pressed mechanism.

17. An image forming apparatus comprising:

a toner cartridge that includes:

a container body that contains toner and that has an opening portion provided on an outer face of the container body and a guide piece provided on the outer face;

a first cover that opens and closes the opening portion; and a second cover that is supported by the guide piece and configured to slide in a direction opposite to an insert direction such that the leading edge of the second cover moves from a position closer to the container body than the first cover to a position further from the container than the first cover as the container body is inserted into an image forming apparatus; and a toner cartridge receiving portion that receives the toner cartridge, wherein the toner cartridge receiving portion includes a pressing mechanism that is configured to press a pressed mechanism.

18. The image forming apparatus according to claim 17, wherein a front end portion of a first bottom surface of the second cover is formed to be inclined so that an angle between the first bottom surface and a second bottom surface of the toner cartridge receiving portion is reduced when the first bottom surface is inclined as the pressed mechanism is pressed by the pressing mechanism.

* * * * *